US011130600B2

(12) United States Patent
Larsson

(10) Patent No.: US 11,130,600 B2
(45) Date of Patent: Sep. 28, 2021

(54) TRANSFER PLATE AND ATTACHMENT UNIT FOR CONTAINER ELEMENT

(71) Applicant: AR Packaging Systems AB, Lund (SE)

(72) Inventor: Lennart Larsson, Malmö (SE)

(73) Assignee: AR Packaging Systems AB

( * ) Notice: Subject to any disclaimer, the term of this patent is extended or adjusted under 35 U.S.C. 154(b) by 320 days.

(21) Appl. No.: 16/315,921

(22) PCT Filed: Jul. 6, 2017

(86) PCT No.: PCT/SE2017/050754
§ 371 (c)(1),
(2) Date: Jan. 7, 2019

(87) PCT Pub. No.: WO2018/009135
PCT Pub. Date: Jan. 11, 2018

(65) Prior Publication Data

US 2019/0233148 A1 Aug. 1, 2019

(30) Foreign Application Priority Data

Jul. 7, 2016 (SE) ..... 1651001-8

(51) Int. Cl.
*B65B 31/02* (2006.01)
*B65B 7/28* (2006.01)
(Continued)

(52) U.S. Cl.
CPC ..... *B65B 31/025* (2013.01); *B65B 7/2807* (2013.01); *B65B 43/46* (2013.01); *B65B 43/52* (2013.01); *B65B 43/14* (2013.01)

(58) Field of Classification Search
CPC ..... B65B 31/025; B65B 43/46; B65B 43/14; B65B 43/52; B65B 7/2807; B65G 25/04; B67B 2201/06; B67B 3/06; B67B 3/062
(Continued)

(56) References Cited

U.S. PATENT DOCUMENTS 1,360,463 A * 11/1920 Strandt ..... B67B 1/10 53/310
1,381,278 A * 6/1921 Canton ..... B67B 1/10 53/167
(Continued)

FOREIGN PATENT DOCUMENTS

| | | |
|---|---|---|
| CN | 205098586 U | 3/2016 |
| JP | H01254526 A | 10/1989 |
| WO | 2013009226 A1 | 1/2013 |

OTHER PUBLICATIONS

International Search Report for Application No. PCT/SE2017/050754 dated Oct. 5, 2017, 5 pages.
(Continued)

*Primary Examiner* — Robert F Long
*Assistant Examiner* — Eduardo R Ferrero
(74) *Attorney, Agent, or Firm* — Lerner, David, Littenberg, Krumholz & Mentlik, LLP

(57) ABSTRACT

The present disclosure relates to a transfer plate for a container element. The transfer plate extends in a first direction and a second direction being perpendicular to each other. The transfer plate comprises a cavity portion comprising at least one through-going first cavity adapted to receive and hold the container element, the first cavity having a first open area. The transfer plate further comprises a cover portion being at least as large as, or substantially as large as, the first open area.
The disclosure further relates to an attachment unit for attaching a container element to a container body and to an apparatus for attaching container elements to container bodies in a flow of containers. In addition the disclosure relates to a method of attaching a container element to a container body by means of the attachment unit.

17 Claims, 6 Drawing Sheets

(51) Int. Cl.
*B65B 43/46* (2006.01)
*B65B 43/52* (2006.01)
*B65B 43/14* (2006.01)

(58) Field of Classification Search
USPC ..... 53/306, 309, 310, 311, 312
See application file for complete search history.

(56) References Cited

U.S. PATENT DOCUMENTS 1,550,741 A * 8/1925 Pinkerton ..... B67B 3/22 53/310
1,614,467 A * 1/1927 Goldberger ..... B67B 1/10 53/305
1,649,459 A * 11/1927 Fullips ..... B67B 1/10 53/299
1,665,079 A * 4/1928 Wright ..... B67B 1/10 221/238
1,752,008 A * 3/1930 Kloss ..... B67B 1/10 53/296
1,865,402 A * 6/1932 Swentor ..... B67B 1/10 53/310
1,865,804 A * 7/1932 Turner ..... B67B 1/10 221/236
1,866,255 A * 7/1932 Greenman ..... B67B 1/10 53/310
1,931,435 A * 10/1933 Davis ..... B67B 1/10 53/296
1,981,565 A * 11/1934 Namur ..... B67B 1/10 221/238
2,015,913 A * 10/1935 Von Sydow ..... B67B 3/22 221/293
2,138,271 A * 11/1938 Fagan ..... B67B 1/10 221/187
2,167,894 A * 8/1939 Kotcher ..... B67C 3/04 53/281
2,264,738 A * 12/1941 Blann ..... B25B 27/20 221/238
2,768,491 A * 10/1956 Gatheridge ..... B65B 7/2807 53/310
2,772,531 A * 12/1956 Brodsky ..... B65B 7/28 53/283
2,841,939 A * 7/1958 Marceau ..... B67B 3/062 53/310
3,554,404 A 1/1971 Schmid
3,712,483 A * 1/1973 Messervey ..... B65G 57/307 414/795.1
3,835,619 A * 9/1974 Reisman ..... B65D 3/04 53/138.2
3,894,379 A * 7/1975 Naggert ..... B65B 7/285 53/486
4,065,909 A * 1/1978 Mueller ..... B65B 7/168 53/420
4,077,188 A 3/1978 Strombeck et al.
4,148,933 A * 4/1979 Janovtchik ..... A23L 3/10 426/402
4,184,523 A * 1/1980 Carrigan ..... B65B 3/30 141/238
4,307,557 A * 12/1981 Shimizu ..... B65B 7/2842 53/131.3
4,345,413 A * 8/1982 McCranie ..... B65B 7/2807 53/315
4,531,342 A * 7/1985 Wittenborg ..... G07F 13/10 222/2
4,835,943 A * 6/1989 Mueller ..... B65B 7/2807 53/202
4,938,649 A * 7/1990 ter Horst ..... B65B 7/2807 198/415
4,959,944 A * 10/1990 Heisler ..... B65B 7/2807 221/212
5,119,549 A * 6/1992 Foote, Jr. ..... B23P 21/00 29/281.4
5,493,849 A * 2/1996 Itoh ..... B65B 7/2821 53/489
5,746,042 A * 5/1998 Lombardi ..... B65B 7/2807 53/305
5,927,468 A * 7/1999 Corniani ..... B65G 47/244 198/392
2001/0052483 A1 12/2001 Orange et al.
2006/0242927 A1* 11/2006 Gorzynski ..... B65B 7/2807 53/287
2014/0215973 A1* 8/2014 Hagelqvist ..... B65B 7/2878 53/478
2017/0267382 A1* 9/2017 Martin ..... B65B 7/2807

OTHER PUBLICATIONS

Swedish Search Report Application No. 1651001-8 dated Mar. 20, 2017, 2 pages.
Extended European Search Report including the Written Opinion for Application No. EP 17824637.7 dated Jan. 8, 2020, 5 pages.

* cited by examiner

TRANSFER PLATE AND ATTACHMENT UNIT FOR CONTAINER ELEMENT

CROSS-REFERENCE TO RELATED APPLICATIONS

The present application is a national phase entry under 35 U.S.C § 371 of International Application No. PCT/SE2017/050754, filed Jul. 6, 2017, which claims priority from Swedish Application No. 1651001-8, filed Jul. 7, 2016, all of which are hereby incorporated herein by reference.

TECHNICAL FIELD

The present disclosure relates to a transfer plate for a container element. The disclosure further relates to an attachment unit for attaching a container element to a container body and to an apparatus for attaching container elements to container bodies in a flow of containers. In addition the disclosure relates to a method of attaching a container element to a container body by means of the attachment unit.

BACKGROUND

When packaging consumer goods, and in particular when packaging dry flowable consumer goods, it is common to use rigid paperboard packaging containers which serve as protective transport and storage containers at the retail end and as storage and dispensing containers at the consumer end. Such paperboard containers are usually provided with an openable and closable lid.

Document WO 2013/009226 A1 discloses an apparatus and method for sealing a cardboard based container. The apparatus comprises: a welding unit configured to fasten a lid to the container, which welding unit comprises an inductive welding energy generator for melting of a weldable layer that forms part of the container and/or the lid; and transporting means configured to transport a flow of containers to and from the welding unit. The transporting means comprises, in a container flow order, a feeding arrangement, a main conveyor member and a movable gripping arrangement, wherein the feeding arrangement is configured to transfer containers one by one in a continuous manner to the main conveyor member, wherein the movable gripping arrangement is configured to transfer containers from the main conveyor member to the welding unit, and wherein the apparatus is arranged in such a way that, during normal operation of the apparatus, the containers line up close to each other at an upstream side of the feeding arrangement, wherein the feeding arrangement is configured to, during operation, separate adjacent containers from each other in the direction of transport by increasing the feeding speed of each individual container along the feeding arrangement and thereby increasing the distance between adjacent containers fed along the feeding arrangement, wherein the main conveyor member is configured to operate at a transport speed that approximately corresponds to, and is uniform in relation to, a discharge speed of the containers when fed out from the feeding arrangement such that containers transferred to and along the main conveyor member remain separated, wherein the moveable gripping arrangement is configured to grip at least two containers and transfer these containers simultaneously from the main conveyor member to the welding unit, and wherein the welding unit is configured to simultaneously fasten a lid to each of the simultaneously transferred containers. Document WO 2013/009226 A1 also discloses a method for operating an apparatus of this type.

SUMMARY

The object of the present disclosure is to overcome or ameliorate at least one of the disadvantages of the prior art, or to provide a useful alternative.

The object above may be achieved by the subject-matter of claim 1. Embodiments are set forth in the appended dependent claims, in the following description and in the drawings.

Thus, the present invention relates to a transfer plate for a container element. The transfer plate extends in a first direction and a second direction being perpendicular to each other. The transfer plate comprises a cavity portion comprising at least one through-going first cavity adapted to receive and hold the container element, the first cavity having a first open area. The transfer plate further comprises a cover portion being at least as large as, or substantially as large as, the first open area.

The transfer plate is used for transferring the container element between two different locations. The transfer plate may be configured to be located in an attachment unit for attaching a container element to a container body as disclosed herein and which is further described below. The attachment unit may be configured to be located in an apparatus for attaching container elements to container bodies in a flow of containers as is also disclosed herein and further described below.

The term "container element" as used herein comprises an element, which is intended to be attached to the container body in order to form a part of the container. Examples of container elements, for which the transfer plate may be suitably used, are one or more of a bottom disc, a bottom rim, a lid, an upper rim and a sealing disc.

The transfer plate extends in the first direction, which preferably is selected to be parallel to a running direction of the apparatus, and in the second direction being perpendicular to the first direction and preferably coinciding with the transverse direction of the apparatus. The transfer plate may thus have a rectangular or square shape. Further, the transfer plate has a smaller extension in a third direction than in the first and second directions. The third direction forms a thickness direction, which is perpendicular to the first and second directions, i.e. typically coinciding with a vertical direction of the apparatus. The transfer plate may thus form a rectangular parallelepiped.

The transfer plate comprises a cavity portion with at least one through-going first cavity, which is adapted to receive and hold the container element. The first cavity has a first open area and is configured to retain the container element. Since the first cavity is through-going, it is possible to push the container element through the first cavity, such that the container element enters the first cavity from one side of the transfer plate and is then pushed through the first cavity, such that the container element exits the first cavity from the other opposite side of the transfer plate. The shape of the first cavity as seen from above is preferably selected according to the shape of the container element, such that there is no free space between a wall of the first cavity and the container element. Thereby it can be minimized or preferably avoided that gas will leak through the through-going first cavity, when it holds the container element. If the container element is at least somewhat resilient, e.g. due to its material properties, the first open area may be chosen to be somewhat smaller than a cross-sectional area of the container element, e.g. between 0 and 5% smaller.

In case the container element is to comprise a folded edge wall when mounted in the container, e.g. such as a folded or curled edge surrounding a bottom disc, the first open area may correspond to the unfolded surface of the container element. The first open area may thus have an area being less than that of the container element, wherein the area difference corresponds to the portion of the container element being folded as the folded edge wall. Such a folded edge wall may typically have a width in the range of from 1 to 10 mm, preferably in the range of from 2 to 5 mm.

The maximum extension in the first direction of the first open area is typically in the range of from 2 to 40 cm, preferably in the range of from 3 to 30 cm more preferably in the range of from 4 to 20 cm. The maximum extension in the second direction of the first open area is typically in the same range as for the first direction. The first cavity may have a substantially rectangular or square shape with rounded corners. Corner radius may be in the range of from 10 mm to 50 mm. The sides may curve slightly outwards with a curvature being substantially larger that the corner radius, e.g. at least 5 times larger. As an alternative, the first cavity may have an oval, elliptical or circular shape. The shape of the first cavity typically corresponds to the shape of the container.

The cover portion has a shape and a size suitable to cover or substantially cover the first open area. It therefore has a shape and a size which is at least as large as, or substantially as large as, that of the container element. As will be further described below, the cover portion is thereby adapted to cover a second cavity located in a retaining device of the attachment unit, the second cavity having a second open area corresponding to that of the first open area. The container element is adapted to be moved at least partly through the second cavity. The cover portion may be adapted to cover at least 90%, preferably at least 95%, more preferably at least 98% and most preferably 100% of the first open area. Correspondingly, the cover portion may be adapted to cover at least 90%, preferably at least 95%, more preferably at least 98% and most preferably 100% of the second open area.

If the wall of the first cavity is not straight, e.g. comprising a step, the first open area is determined as the smallest cross-sectional area of the first cavity. This may e.g. be the case when the container element is to comprise a folded edge wall when mounted in the container, e.g. a bottom disc.

The cover portion may be arranged adjacent to the cavity portion as seen in the second direction of the transfer plate. It is also possible to have another portion of the transfer plate between the cavity portion and the cover portion as seen in the second direction.

The cover portion may have a minimum extension in the second direction which is at least 1.0 times a maximum extension in the second direction of the first open area, preferably at least 1.2 times, more preferably at least 1.4 times. Thereby the cover portion will be able to cover an area at least as large of that of the first cavity.

The container may be a packaging container, in particular a paperboard packaging container, intended for containing bulk solids.

As used herein, a "paperboard packaging container" is a packaging container wherein the container body is formed from paperboard web material. The paperboard container may be formed in any manner known in the art, e.g. by forming a container body by bending the paperboard web material into a tubular shape and longitudinally closing the tube by joining overlapping or abutting side edges of the sheet material. The join between the side edges may be covered by a sealing strip.

As used herein, a "paperboard web material" is a material predominantly made from cellulose fibres or paper fibres. The web material may be provided in the form of a continuous web or may be provided as individual sheets of material. The paperboard material may be a single ply or multi ply material and may be a laminate comprising one or more layers of materials such as polymeric films and coatings, metal foil, etc. The polymeric films and coatings may include or consist of thermoplastic polymers. The paperboard material may be coated, printed, embossed, etc. and may comprise fillers, pigments, binders and other additives as known in the art. The paperboard materials as disclosed herein may also be referred to as cardboard or carton materials.

As used herein, the term "bulk solids" refers to a solid bulk material from which a desired amount of the product may be poured, scooped or taken by hand out of a packaging container. The bulk material may be dry or moist. The bulk solids which are suitable for packing in the paperboard packaging containers as disclosed herein include any material in the form of particles, granules, grinds, plant fragments, short fibres, flakes, seeds, pieces, etc.

The paperboard packaging container as disclosed herein may be a container for alimentary products such as infant formula, coffee, tea, rice, flour, sugar, cereals, soup powder, custard powder, pasta, snacks, or the like. Alternatively, the bulk solids may be non-alimentary, such as tobacco, detergent, fertilizer, chemicals or the like.

The container element may be made of paperboard, metal, plastic, or from any suitable combination of such materials as known in the art. Purely as examples: The container element may be of the same material as that of the container body, e.g. if the container element is the bottom disc. Alternatively, the container element may be of plastics, e.g. if the container element is the bottom rim, the upper rim or the lid. The container element may also be of metal, e.g. if the container element is the sealing disc.

The transfer plate may comprise one or more holding elements adapted to hold the container element in the first cavity. The one or more holding elements may be located at a wall of the first cavity, preferably at a centre of a side of the wall.

The wall of the first cavity may comprise holding elements adapted to hold the container element in the first cavity. One, two, three, four or more holding elements may be provided. There may e.g. be four such holding elements adapted to hold each of the sides of the container element for the case that the container has a substantially rectangular or square shape. The holding elements are then preferably located at a centre of each side of the substantially rectangular or square first cavity wall. The holding elements may be resilient, e.g. due to material properties or by being biased by a spring. As an alternative, or a complement, the container element itself may be resilient, e.g. due to material properties. The holding elements may be utilized to compensate for tolerances regarding the dimensions of the container element and/or the first cavity. In addition, or as a complement, the holding elements may be used to temporarily press the sides of the container element, e.g. the bottom rim, inwards, such that the container element will be easier to insert into the container body, thereby lowering or avoiding the risk of damaging the edges of the container body during insertion of the container element.

The one or more holding elements adapted to hold the container element in the first cavity as described herein would also be useful for a transfer plate according to known technology, e.g. for the transfer plate as described in WO 2013/009226 A1. Further, a transfer plate with the one or more holding elements could be useful both for an apparatus with and an apparatus without protective gas atmosphere.

The transfer plate may comprise one or more indentations adapted to allow space for gripping of the container element, the indentation/s preferably being located at one or more corners of the first cavity.

In order to facilitate placing the container element into the first cavity, there may be one or more indentations arranged around the first cavity intended to allow space for one or more gripping members. The indentations do not form holes going all the way through the transfer plate.

If also having holding elements as described herein, the indentations are preferably located not to interfere with the holding elements. The indentations may thus be located in the corners of the first cavity. Such gripping members and their corresponding indentations around the first cavity are especially useful when the container element does not comprise a disc shape, but instead forms a loop, which comprises an inner volume filled by gas, e.g. air, such as a bottom rim.

If the container element instead comprises a disc shape, such as a bottom disc, lid or sealing disc, the container element may instead be placed into the first cavity by means of e.g. a suctions cup. However, suction cups are not suitable when the container element forms a loop, such as for the bottom rim.

The one or more indentations adapted to allow space for gripping of the container element as described herein would also be useful for a transfer plate according to known technology, e.g. for the transfer plate as described in WO 2013/009226 A1. Further, a transfer plate with the one or more indentations could be useful both for an apparatus with and an apparatus without protective gas atmosphere. In particular, it is often beneficial to provide a transfer plate comprising both one or more indentations and one or more holding elements.

The transfer plate may comprise a plurality of cavity portions, each cavity portion comprising a respective first cavity and being arranged together with a corresponding cover portion. Preferably the cavity portions are arranged in a row as seen in the first direction. It has been found suitable to transfer a plurality of container elements at the same time, in order to increase the running speed of the apparatus. Purely as examples, two, three, four, six, eight, ten or more container elements may be transferred at the same time. Hence, two, three, four, six, eight, ten or more cavity portions with corresponding first cavities may be arranged in a row in the transfer plate.

The present invention further relates to an attachment unit for attaching a container element to a container body. The attachment unit comprises a retaining device, adapted to retain the container body, while the container element is being attached to the container body, an applicator for positioning the container element in the container body and a transfer plate as described herein. The retaining device comprises at least one through-going second cavity with a second open area corresponding to that of the first open area, the second cavity being adapted to receive a portion of the container body. The applicator is aligned with the second cavity. The transfer plate is displaceable between a first position, in which the transfer plate is adapted to receive the container element in the first cavity, and a second position in which the first cavity is aligned with the second cavity of the retaining device. In the first position, the transfer plate is located, such that the cover portion covers or substantially covers the second open area. In the second position, the transfer plate is located between the applicator and the second cavity of the retaining device, such that the container element is displaceable by means of the applicator from the first cavity in the transfer plate into the container body by moving through the first cavity and at least partly through the second cavity of the retaining device.

The size and shape of the cover portion of the transfer plate is preferably selected, such that the cover portion is able to cover, or at least substantially cover the second open area. As mentioned above, the cover portion may be adapted cover at least 90%, preferably at least 95%, more preferably at least 98% and most preferably 100% of the second open area.

The attachment unit may, as an option, comprise a supporting device, adapted to support the container body and to position the container body in the retaining device. The supporting device may e.g. insert the container body from below into the retaining device and move the container device upwards until it reaches a desired preselected position.

The orientation of the container body depends on which container element is to be attached. Purely as an example: If attaching a lid or an upper rim, the container body is preferably held with an upper body opening facing upwards. However, if attaching a bottom disc or a bottom rim, the container body is preferably held with a bottom body opening facing upwards. A sealing disc may be attached from either of the two container body openings.

The applicator is adapted to position the container element in the container body. Hence, the applicator is aligned with the second cavity as seen in the vertical direction. The applicator may be vertically adjustable and capable of pressing down the container element into the container body to the desired attachment position. Further, the applicator may be expandable in a radial direction of the second cavity to be able to press a vertical portion of the container element, e.g. a folded edge wall of a bottom disc, circumferentially in a direction towards a wall of the second cavity, i.e. press against an inside of a container wall of the container body placed in of the second cavity.

The transfer plate is displaceable between at least a first position and a second position. There may also be additional positions, e.g. intermediate positions in between. In the first position, the transfer plate is adapted to receive the container element in the first cavity. Further, the transfer plate is positioned, such that the cover portion covers or substantially covers the second open area. Thereby, a flow of gas through the second cavity is minimized, or preferably avoided.

In the second position, the first cavity of the transfer plate is aligned with the second cavity of the retaining device and hence also with the applicator. Thereby it is possible for the applicator to displace the container element from the first cavity in the transfer plate into the container body by moving the container element through the first cavity and at least partly through the second cavity of the retaining device.

The attachment unit may comprise an internal housing being arranged to provide and maintain a protective gas atmosphere above the second cavity of the retaining device. The internal housing comprises a gap, e.g. located at a first side wall of the internal housing. The transfer plate is displaceable between the first and second positions by translational movement relative to the internal housing in the gap, wherein in the first position of the transfer plate the first cavity is outside the internal housing and in the second position the first cavity is inside the internal housing.

The retaining device may form a bottom wall of the internal housing. The internal housing may at least partly enclose the applicator. Purely as an example, a top wall of the internal housing may comprise an opening, through which the applicator passes. The applicator is then axially displaceable in relation to the internal housing, such that the applicator is able to perform the above-mentioned displacement of the applicator through the first cavity and at least partly through the second cavity of the retaining device. In that case, one or more seals, e.g. bushings, may be located on a rod of the applicator and/or around a circumference of the opening in order to prevent gas from leaking out from the internal housing. It would also be feasible that the internal housing encloses the applicator and/or the retaining device.

Depending on the size of the internal housing, there may also be an additional gap, e.g. located at a second side wall of the internal housing, which second side wall is opposite to that of the first side wall. When the transfer plate is in its second position, parts of the transfer plate, e.g. the cover portion, may protrude through the additional gap.

One or more parts of the attachment unit are at least partly located outside the internal housing. As mentioned above, the transfer plate is partly outside the internal housing in its first position when receiving the container element. Further, the retaining device may be located below the internal housing but adjacent to it, e.g. if forming the bottom wall.

The attachment unit may in addition or as a complement comprise a beam in which one or more guiding bushings for the rod of the applicator may be located. In that case, the beam may, at least partly, form the top wall of the internal housing. Alternatively, the internal housing may be attached tightly against the beam, such that the beam, with its optional guiding bushings, may help to minimize gas leakage through the opening of the internal housing, through which opening the applicator passes.

Also the gap, and the optional additional gap, is adapted to minimize, or preferably avoid, any flow of gas through the gap. Hence the width of the gap is adapted to the height of the transfer plate, i.e. the extension in the third direction of the transfer plate.

The protective gas may be nitrogen, carbon dioxide or a mixture of nitrogen and carbon dioxide. It is preferable that the internal housing forms a gas chamber, which is as closed as possible in order to minimize losses of the protective gas and/or to minimize entrance of surrounding air.

The internal housing may comprise a gas inlet. The gas inlet may be used for supplying additional protective gas in order to compensate for losses, if any.

The internal housing is especially useful when the container element does not comprise a disc shape, but instead forms a loop, which comprises an inner volume filled by gas, e.g. air, such as an upper rim or a bottom rim. In that case, the air being transported with the container element inside the rim is undesired since it adds air to the protective gas. However, by utilizing the internal housing, the air is dispersed in the protective gas atmosphere of the internal housing and hence the effect of the air is minimized. Further, an amount of protective gas corresponding to the volume of air transported in the inner volume of the container element may be added to the internal housing to retain the protective gas atmosphere.

The retaining device may comprise a welding unit, preferably arranged around the second cavity. The welding unit is adapted to weld the container element to the container body, e.g. the welding unit comprising a coil extending around the second cavity. Any suitable welding technique may be used, such as ultrasonic welding or high frequency welding, with high frequency welding being preferred. If the applicator is expandable in a radial direction of the second cavity, as described above, the container element can be pressed against the welding unit.

In case the above-mentioned internal housing with gas inlet is utilized, the gas inlet can be used to supply additional protective gas, such that it can be ascertained that there is no air, or substantially no air, present when welding. The amount of added gas thus preferably corresponds at least to the amount of air transported with the container element.

As an alternative or a complement to welding, an adhesive may be applied to the container element before attaching it to the container body. However, this requires a further component to be added to the container as well as equipment for supplying and applying the adhesive.

As mentioned above, the transfer plate may comprise a plurality of cavity portions, each cavity portion comprising a respective first cavity and being arranged together with a corresponding cover portion. The retaining device may comprise a corresponding plurality of second cavities. The optional supporting device may be adapted to support a corresponding plurality of container bodies and to position the portions of them in the second cavities of the retaining device. The attachment unit may comprise a corresponding plurality of applicators aligned with the second cavities, such that each applicator is associated with a respective second cavity. Correspondingly as for the transfer plate, preferably the second cavities and the applicators are arranged in a row as seen in the first direction. The plurality may be two, three, four, six, eight, ten or more first cavities, cover portions, second cavities and applicators.

The applicators may be adapted to simultaneously position the plurality of container elements in the respective container bodies. It has been found suitable to attach a plurality of container elements to a respective container body at the same time, in order to increase the running speed of the apparatus. Purely as examples, two, three, four, six, eight, ten or more container elements may be attached at the same time.

The present invention further relates to an apparatus for attaching container elements to container bodies in a flow of containers. The apparatus comprises a transport means configured to transport the flow of containers through the apparatus and at least one attachment unit as described herein arranged along the transport means.

The transport means may comprise one or more conveyor members, a feeding arrangement, e.g. in the form of two feed screw members at respective opposite sides of the container body, and/or one or more movable gripping arrangements. The components of the transport means may be similar to the ones described in the above-mentioned patent document WO 2013/009226 A1, to which document reference is made for further details. The transport means transports the container bodies to and from the attachment unit.

The apparatus may comprise a first attachment unit as described herein arranged along the transport means arranged to attach a disc, e.g. a bottom disc, to the container bodies, and a second attachment unit as described herein arranged along the transport means arranged to attach a reinforcing rim, e.g. a bottom rim, to the container bodies, the second attachment unit being located downstream of the first attachment unit. The transport means is adapted to transport the container bodies to the first attachment unit, between the attachment units and/or from the second attachment unit and onwards. If more than one attachment unit is used, one or more of them may comprise an internal housing as described herein. Purely as an example, a first attachment housing for attaching a container element with a disc shape may be without an internal housing, while a second attachment unit for attaching a rim may comprise the internal housing.

The apparatus may in addition comprise further attachment units as described herein. There may e.g. be attachment units for one or more of the container elements mentioned herein, i.e. the bottom disc, the bottom rim, the lid, the upper rim or the sealing disc. Further, a single attachment unit may be utilized for attaching more than one container element.

The apparatus may comprise an external housing arranged to enclose the transport means and the at least one attachment unit. The external housing thereby also encloses the optional internal housing, which may be comprised in the attachment unit. The external housing may be used to protect the apparatus from interference from the outside. The external housing may be adapted to provide and maintain a protective gas atmosphere. This may be beneficial in order to maintain the protective gas in the container, in case the content of the container, e.g. the bulk solids, has previously been filled into the container in a protective gas atmosphere. The external housing and the internal housing may together function as a two-step entrance when attaching the container element in the protective gas atmosphere.

As mentioned above, one or more parts of the attachment unit are at least partly located outside the optional internal housing but inside the external housing. Purely as an example, the above-mentioned transfer plate is inside the external housing in both the first and second positions. Further, the applicator is located inside the external housing.

Two or more apparatuses may be provided, e.g. a first apparatus for attaching container elements with disc shape, such as bottom discs, and a second apparatus for attaching rims, such as bottom rims. It is preferred that at least the first apparatus utilizes protective gas atmosphere. The external housing as described herein may be provided for the first apparatus only. The second apparatus may then be utilizing normal atmosphere.

The present invention also relates to a method of attaching a container element to a container body by means of an attachment unit as described herein. The method comprises:

- positioning the transfer plate in the first position,
- placing the container element in the first cavity,
- displacing the transfer plate to the second position,
- displacing the container element from the first cavity in the transfer plate into the container body by means of the applicator by moving through the first cavity and at least partly through the second cavity of the retaining device,
- fixing the container element to the container body, e.g. by means of welding and/or an adhesive.

Thereafter the transfer plate is displaced back to the first position and the cycle can start again.

If utilizing an attachment unit with a plurality of first cavities, second cavities and applicators, the plurality of container elements may be simultaneously positioned into the respective container bodies by the applicators.

If the container element is a rim, the method may comprise supplying additional gas, preferably an amount of protective gas corresponding to an amount of gas being located in a volume delimited by the rim.

BRIEF DESCRIPTION OF THE DRAWINGS

The present invention will hereinafter be further explained by means of non-limiting examples with reference to the appended drawings wherein.

It should be noted that the appended drawings are schematic and that individual components are not necessarily drawn to scale and that the dimensions of some features of the present invention may have been exaggerated for the sake of clarity.

DETAILED DESCRIPTION

The invention will, in the following, be exemplified by embodiments. It should however be realized that the embodiments are included in order to explain principles of the invention and not to limit the scope of the invention, as defined by the appended claims. Details from two or more of the embodiments may be combined with each other.

Figure 1:
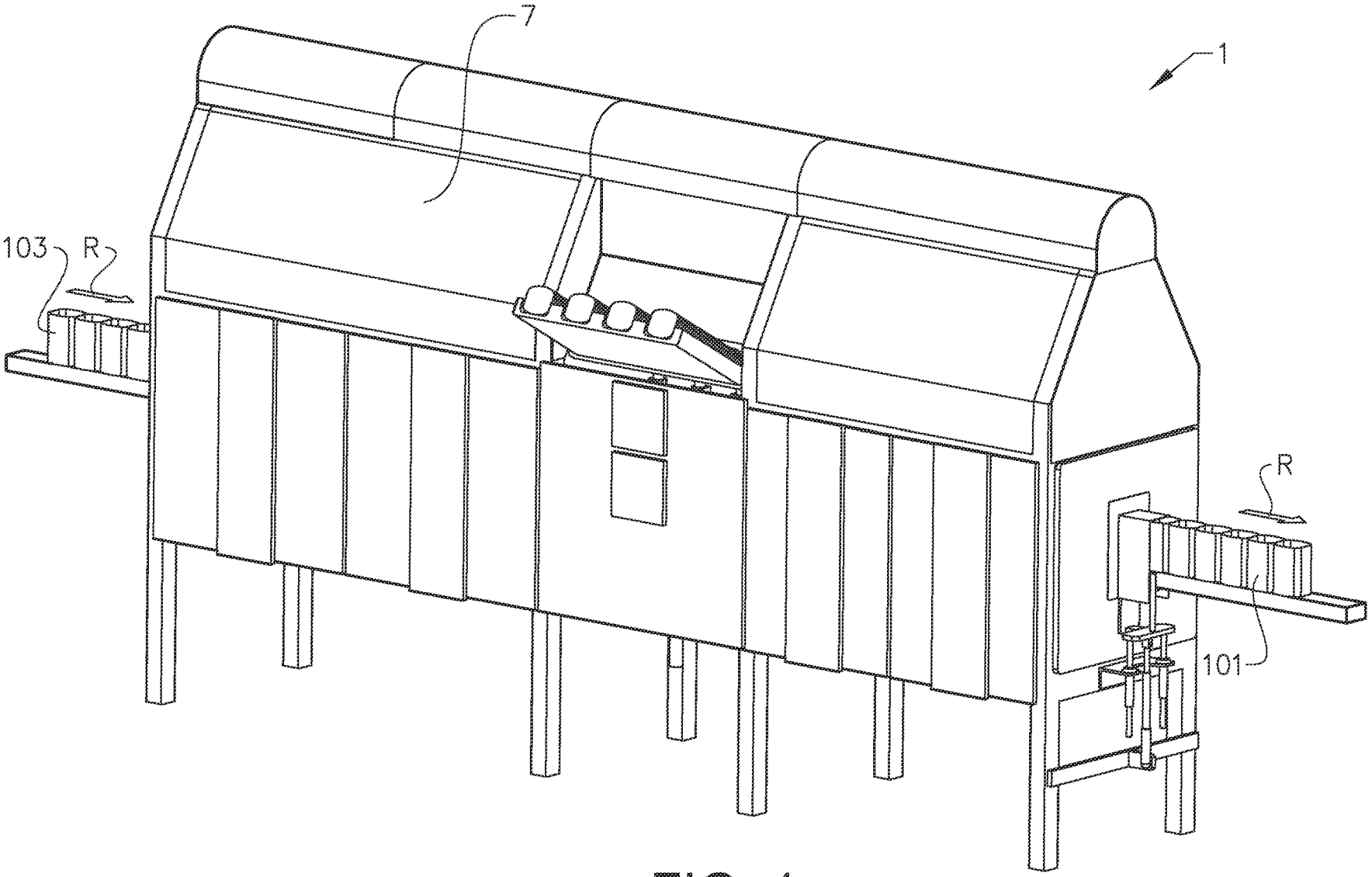
FIG. 1 shows an apparatus according to the invention for attaching container elements to container bodies in a flow of containers in a perspective view.
Figure 2:
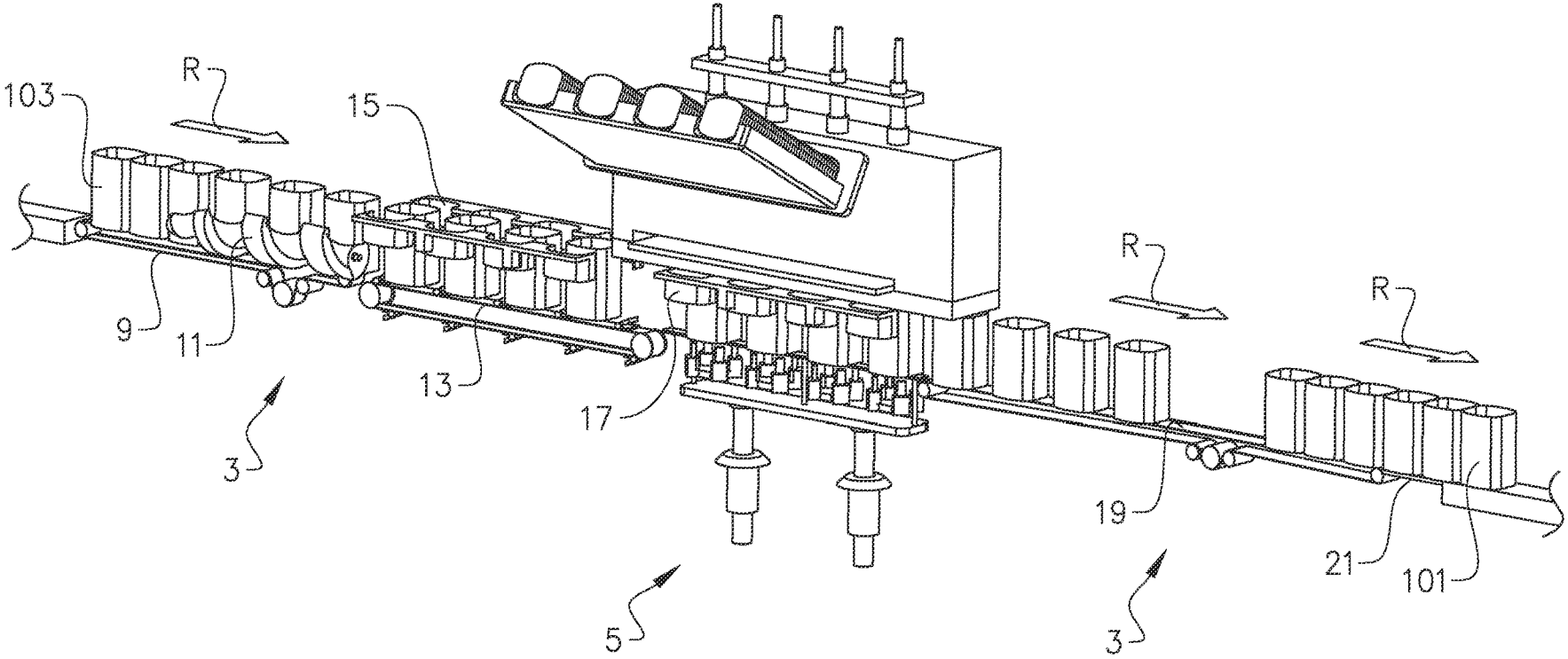
FIG. 2 shows an inside of the apparatus of FIG. 1.
Figure 3:
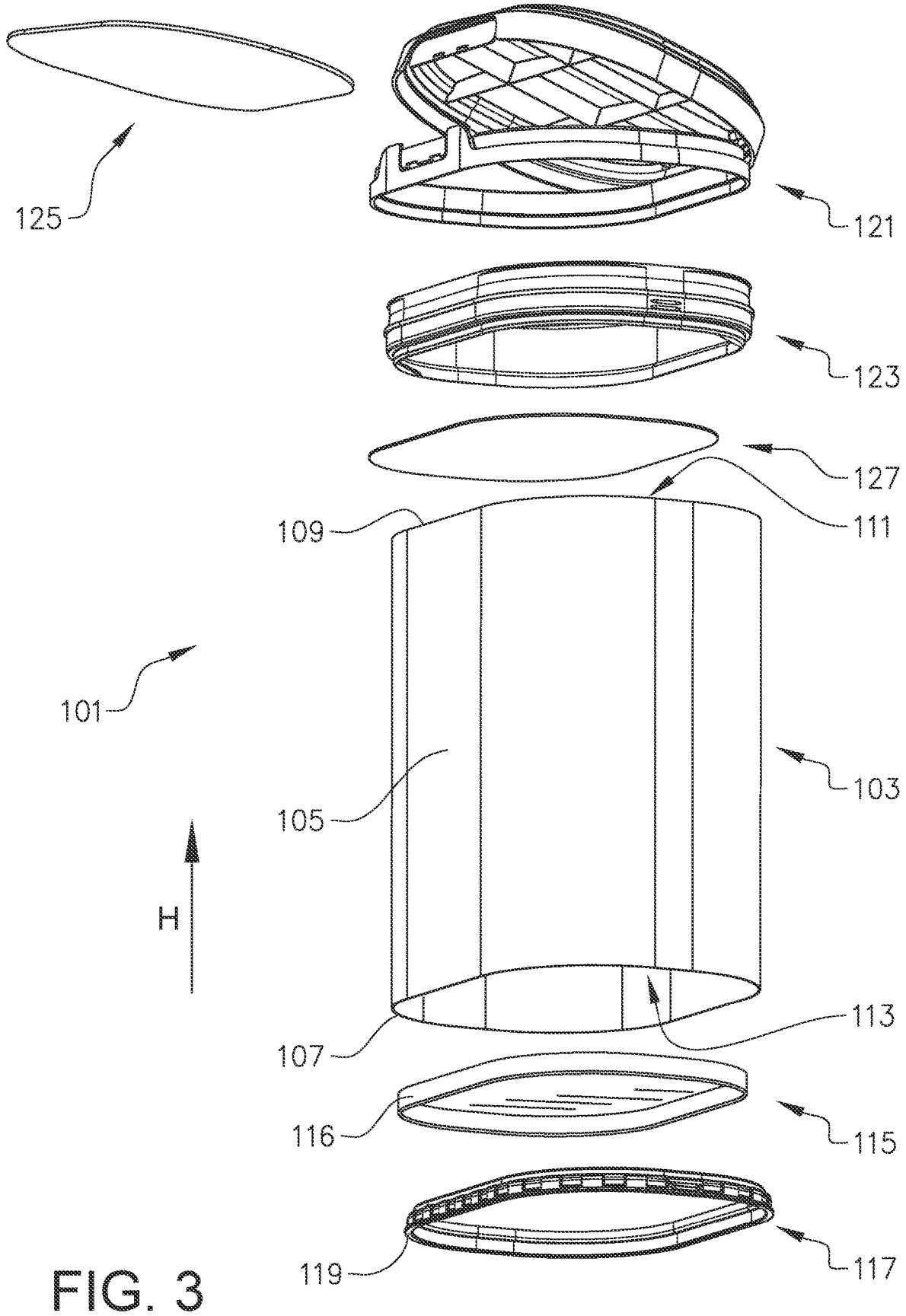
FIG. 3 shows an exemplary container, for which the apparatus is suitable.

FIGS. 1 and 2 illustrate an apparatus 1 according to the invention for attaching container elements to container bodies in a flow of containers. FIG. 3 shows an exemplary container 101, for which the apparatus 1 is suitable.

The apparatus 1 comprises a transport means 3 configured to transport the flow of containers through the apparatus 1 and an attachment unit 5 for attaching a container element to a container body. An external housing 7 is arranged to enclose the transport means 3 and the attachment unit 5. FIG. 1 shows a perspective view of the apparatus 1. FIG. 2 shows an inside of the apparatus 1 with the external housing 7 removed for better visibility.

The apparatus 1 is suitably used for paperboard packaging containers 101 for pourable or scoopable bulk solids, like the one illustrated in FIG. 3. The particular shape of the container 101 shown in the figures should not be considered limiting to the invention, since the apparatus 1 is suitable for containers of any useful shape or size.

The container 101 comprises a container body 103 formed by a tubular container wall 105. The container wall 105 extends in a height direction H of the container 101 from a bottom end edge 107 at a bottom end of the container body 103 to an upper end edge 109 at an upper end of the container body 103. The container body 103 has an upper body opening 111 at the upper end and a bottom body opening 113 at the bottom end. A bottom disc 115 is positioned at the bottom end of the container body 103 and covers the bottom body opening 113. The container body 103 is made from paperboard material as defined herein. The container body 103 may be formed by bringing together the side edges of a web of paperboard causing the material to assume a tubular shape, whereafter the side edges are sealed together. Sealing of the side edges may be made by any suitable method as known in the art, such as by welding or gluing, with welding being preferred. Sealing of the side edges of the container body web may involve using a sealing strip which is applied over the join between the side edges, as known in the art. The bottom disc 115 may be made from paperboard, metal, plastic, or from any suitable combination of such materials as known in the art. The bottom disc 115 may have a folded edge wall 116.

The bottom end edge 107 is reinforced by a reinforcing bottom rim 117 which is applied to the inner surface of the container wall 105 and/or to the folded edge wall 116 of the bottom disc 115, between the bottom disc 115 and the bottom end edge 107. In the illustrated embodiment, the bottom rim 117 has an outwardly directed flange 119 which covers the bottom end edge 107 and forms a bottom edge of the container 101. The bottom rim 117 reinforces the bottom end edge 107, stabilizes the shape of the container body 103 and protects the bottom edge 107 from mechanical deformation. The bottom rim 117 also serves as a protective barrier against water and other fluids which may be present on a surface on which the container 101 is placed. The bottom rim 117 delimits a downwardly open space between the bottom disc 115 and the bottom edge of the container 101, which may be used to accommodate stacking elements arranged at an upper end of another container when stacking two or more containers on top of each other.

As an alternative to the illustrated bottom rim 117, the bottom edge of the container may be formed by a rolled edge of the container body 103, or may be provided by a simple, non-rolled join between the bottom disc 115 and the container body 103.

The container 101 is provided with a closure arrangement comprising a lid 121 and a reinforcing upper rim 123 extending along the container body opening edge 109. The lid 121 comprises a planar disc 125. The exemplary container 101 is further provided with a fully or partly removable sealing disc 127 which is adapted to be sealed to the container body wall 105.

The bottom disc 115, the bottom rim 117, the lid 121, the upper rim 123 and the sealing disc 127 are examples of container elements for which the apparatus 1 is suitably used to attach the container element to the container body 103.

The bottom rim 117 and the upper rim 123 are typically made of plastics. As may be gleaned in FIG. 3, the bottom rim 117 and the upper rim 123 form closed loops with a main extension in a loop plane. The closed loop encloses an open space in the centre. The bottom rim 117 and the upper rim 123 also have a respective extension in the height direction H of the container 101. Thereby, the closed loop defines an inner volume of the bottom rim 117 and the upper rim 123, respectively.

The bottom disc 115, the lid 121 and the sealing disc 127 are adapted to extend over the cross-section of the container body. Although the sealing disc 127 is a substantially two-dimensional component, the bottom disc 115 and the lid 121 extend also in the height direction H of the container 101, such that their interiors define an inner volume, which is filled by gas, e.g. air.

Going back again to FIGS. 1 and 2, it can be seen that a conveyor feeds container bodies 103 to the apparatus 1. Another conveyor feeds containers 101 away from the apparatus 1. In the exemplary illustrated embodiment of the apparatus 1, it is assumed that the sealing disc 127, the upper rim 123 and the lid 121 have already been attached to the container body 103, when it enters the apparatus 1. Further, it is assumed that the material to be contained in the container 101 has been filled into the interior of the container body 103 in a filling unit located upstream of the apparatus 1. Hence, the containers 101 are transported through the apparatus 1 standing upside down, i.e. standing on the lid 121.

FIG. 2 shows of the inside of the apparatus 1. Following a running direction R of the apparatus 1, the transport means 3 comprises an inlet conveyor member 9, a feeding arrangement 11 in the form of two feed screw members at respective opposite sides of the container body 103, whereof one of the feed screw members can be seen in FIG. 2, a main conveyor member 13, a first movable gripping arrangement 15, a second movable gripping arrangement 17, an outlet conveyor member 19 arranged downstream of the attachment unit 5 and a stationary sliding plate 21 arranged at the outlet of the apparatus 1. The components 9, 11, 13, 15, 17, 19, 21 of the transport means 3 are exemplary and are similar to the ones described in WO 2013/009226 A1, to which document reference is made for further details.

Figure 4:
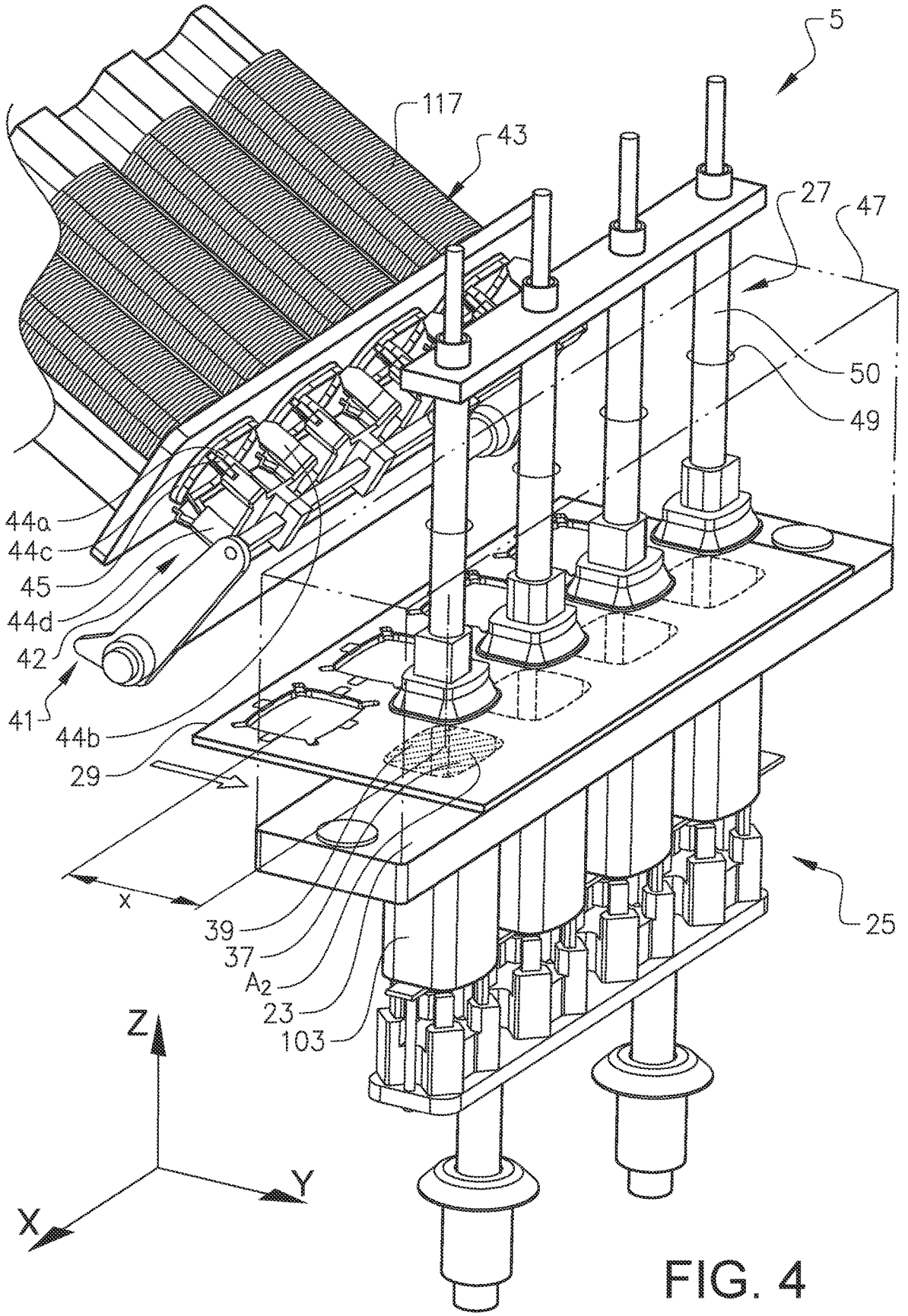
FIG. 4 shows an attachment unit for attaching a container element according to the invention with a transfer plate in a first position.
Figure 5:
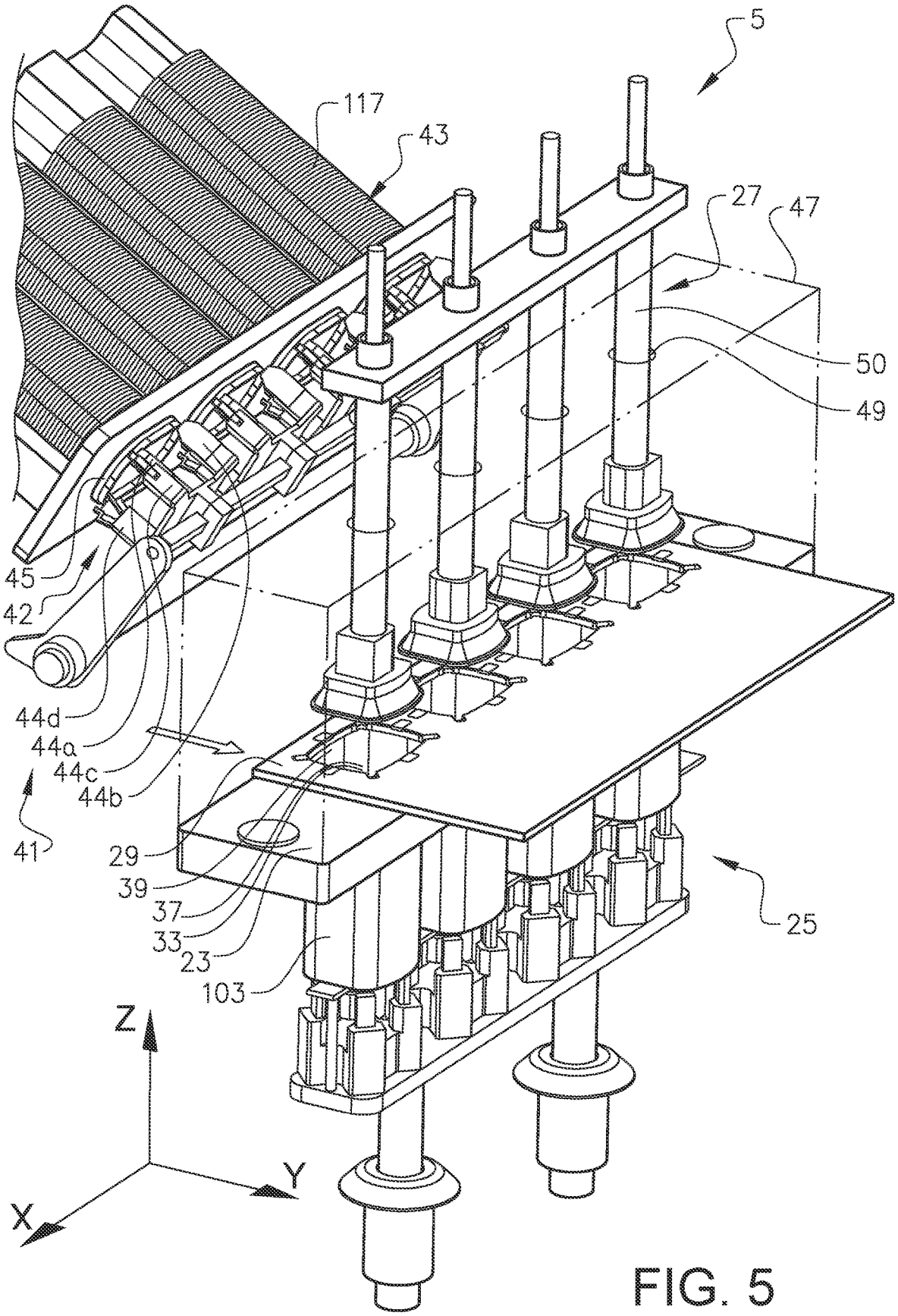
FIG. 5 shows the attachment unit with the transfer plate in a second position.

The attachment unit 5, which is further described below in conjunction with FIGS. 4 and 5, is located between the main conveyor member 13 and the outlet conveyor member 19 as seen in the running direction R of the apparatus 1. The first movable gripping arrangement 15 and the second movable gripping arrangement 17 move the container bodies 103 to and from the attachment unit 5. In the illustrated embodiment, the attachment unit 5 is adapted to attach bottom rims 117 to the container bodies 103. It has been found suitable to simultaneously attach a plurality of bottom rims 117 to a plurality of corresponding container bodies 103, in order to increase the running speed of the apparatus 1. In the illustrated embodiment, four bottom rims 117 are attached at the same time to respective container bodies 103. However, it could also be suitable to attach the bottom rims 117 one by one after each other or to attach any other number of bottom rims 117 than four, e.g. two, three, six, eight or ten, at the same time.

The apparatus 1 may as an option, not illustrated, comprise an additional attachment unit, which is adapted to attach a bottom disc 115 to the container body 103. The additional attachment unit is in that case located upstream of the illustrated attachment unit 5. Similar as for the bottom rims 117, bottom discs 115 can be attached to a plurality of container bodies 103 at the same time, preferably for the same number of container bodies 103 as for attaching the bottom rims 117.

The external housing 7 encloses the transport means 3 and the at least one attachment unit 5. The external housing 7 is adapted to protect the apparatus 1 and to provide and maintain a protective gas atmosphere inside the apparatus 1. The protective gas may be nitrogen, carbon dioxide or a mixture of nitrogen and carbon dioxide. It is therefore preferable that the external housing 7 forms a gas chamber, which is as closed as possible in order to minimize losses of the protective gas and/or to minimize entrance of the surrounding air. However, the external housing 7 may be open downwards.

As an option, degassing of the container may be performed, when filling the material, e.g. the bulk solids, into the container. The degassing may comprise supplying a protective gas to the flow of material to be contained in the container during filling. The protective gas may be nitrogen, carbon dioxide or a mixture of nitrogen and carbon dioxide. The protective gas may be blown into the flow of material before the material reaches the container. If the material is treated with protective gas during filling, the containers are preferably conveyed to the apparatus 1, while maintaining the protective atmosphere, e.g. by moving the containers through a tunnel filled with protective gas. Alternatively, the filled containers may be introduced in a vacuum chamber to draw off air, whereafter the containers are subjected to a protective gas atmosphere and closed.

Even if it is assumed in the illustrated embodiment that the material to be contained in the container has been filled in the container upstream of the apparatus 1, it would also be possible to locate the filling unit inside the external housing 7 of the apparatus. The external housing could in that case enclose the filling unit and/or one or more units for attaching the sealing disc 127, the upper rim 123 and the lid 121.

FIGS. 4 and 5 illustrate the attachment unit 5 for attaching a container element according to the invention. As mentioned above in conjunction with FIGS. 1 and 2, the illustrated embodiment shows attachment of the bottom rim 117. However, such an attachment unit would also be suitable for attachment of the bottom disc 115, the lid 121, the upper rim 123 or the sealing disc 127. The attachment unit 5 comprises a retaining device 23, a supporting device 25, an applicator 27 and a transfer plate 29.

Figure 6:
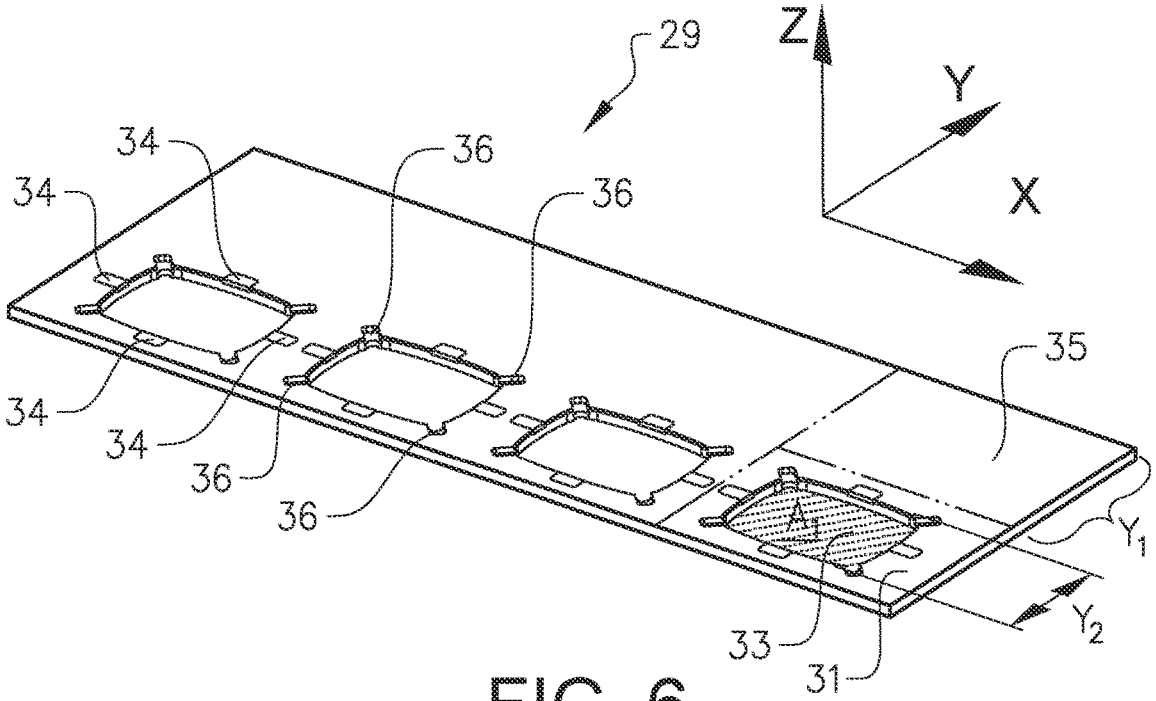
FIG. 6 shows the transfer plate.

An example of a transfer plate 29 is illustrated in FIG. 6. The transfer plate 29 extends in a first direction x, parallel to the running direction R of the apparatus 1, and a second direction perpendicular to first direction x and coinciding with the transverse direction of the apparatus 1. The transfer plate 29 comprises a cavity portion 31 with at least one through-going first cavity 33 adapted to receive and hold the container element 117. The first cavity 33 has a first open area $A_1$ and is configured to retain the container element, e.g. the bottom rim 117.

In order to minimize, or preferably avoid, unnecessary loss of the protective gas, the shape of the first cavity 33 is corresponding to the shape of the container element, e.g. the bottom rim 117. In case the container element is to comprise a folded edge wall when mounted in the container, e.g. the bottom disc 115, the first open area $A_1$ may correspond to the unfolded surface of the container element. The first open area $A_1$ is then less than that of the container element, wherein the area difference corresponds to the portion of the container element being folded into the folded edge wall 116. Such a folded edge 116 wall may typically have a width in the range of from 1 to 10 mm, preferably in the range of from 2 to 5 mm.

A wall of the first cavity 33 may comprise holding elements 34 adapted to hold the container element in the first cavity 33. Such holding elements 34 are especially useful when the container element does not comprise a disc shape, but instead forms a loop, which comprises an inner volume filled by gas, e.g. air, such as the bottom rim 117 or the upper rim 123. If the container element instead comprises a disc shape, such as the bottom disc 115, the lid 121 or the sealing disc 127, the holding elements 34 may be omitted.

In the illustrated embodiment, there are four such holding elements 34 adapted to hold each of the sides of the container element, which in the illustrated embodiment is substantially rectangular, preferably at a centre of each side. It would be feasible to use one, two, three, four or more such holding elements 34. The holding elements 34 may be resilient, e.g. due to material properties or by being biased by a spring. As an alternative, or a complement, the container element itself may be resilient, e.g. due to material properties. The holding elements 34 may be utilized to compensate for tolerances regarding the dimensions of the container element 115, 117, 121, 123, 127 and/or the first cavity 33. In addition, or as a complement, the holding elements 34 may be used to temporarily press the sides of the container element, e.g. the bottom rim 117, inwards, such that the container element will be easier to insert into the container body 103, thereby lowering or avoiding the risk of damaging the edges of the container body 103 during insertion of the bottom rim 117.

The transfer plate 29 comprises a cover portion 35 being at least as large as, or substantially as large as, the first open area $A_1$ of the first cavity 33. The cover portion 35 is arranged adjacent to the cavity portion 31 as seen in the second direction y. The cover portion 35 has a minimum extension $y_1$ in the second direction y, which is at least 1.0 times a maximum extension $y_2$ in the second direction y of the area $A_1$ of the first cavity 33, preferably at least 1.2 times, more preferably at least 1.4 times.

In order to facilitate placing the container element 115, 117, 121, 123, 127 into the first cavity 33, there are in the illustrated embodiment of FIG. 6 indentations 36 intended to allow space for gripping members 44*a*, 44*b*, 44*c*, 44*d*. See below for further description of the gripping members. If utilizing holding elements 34, the indentations 36 are preferably located not to interfere with the holding elements 34. The indentations 36 may thus be located in the corners of the first cavity 33. Such gripping members 44*a*, 44*b*, 44*c*, 44*d* with their corresponding indentations 36 are especially useful when the container element does not comprise a disc shape, but instead forms a loop, which comprises an inner volume filled by gas, e.g. air, such as the bottom rim 117.

If the container element comprises a disc shape, such as the bottom disc 115, the lid 121 and the sealing disc 127, the container element 115, 121, 127 may instead by placed into the first cavity 33 by means of e.g. a suction cup. In that case, the indentations 36 may be omitted. However, suction cups are not suitable when the container elements form a loop.

In the illustrated embodiment, there are four cavity portions 31 arranged in a row as seen in the first direction x. Each cavity portion 31 comprises a respective first cavity 33 and is arranged together with a corresponding respective cover portion 35.

The retaining device 23 is adapted to retain the container body 103 while the container element, illustrated as the bottom rim 117, is being attached to the container body 103. The retaining device 23 comprises at least one through-going second cavity 37 with a second open area $A_2$ corresponding to the first open area $A_1$ of the first cavity 33, the second cavity 37 being adapted to receive a portion of the container body 103. The size and shape of the cover portion 35 of the transfer plate 29 is selected, such that the cover portion 35 is able to cover, or at least substantially cover, the second open area $A_2$ of the second cavity 37.

The supporting device 25 is adapted to support the container body 103 and to position the container body 103 in the retaining device 23.

The applicator 27 is adapted to position the container element 117 in the container body 103. Hence, the applicator 27 is aligned with the second cavity 37 as seen in a vertical direction z. The applicator 27 is vertically adjustable and capable of pressing down the container element into the container body 103 to the desired attachment position. Preferably, the applicator 27 is further expandable in a radial direction of the second cavity 37 to be able to press a vertical portion of the container element circumferentially in a direction towards a wall of the second cavity 37, i.e. to press against an inside of the container wall 105 of the container body 103 placed in of the second cavity 37.

In the illustrated embodiment, the transfer plate 29 comprises four cavity portions 31 arranged in a row as seen in the first direction x. In a corresponding way, the retaining device 23 comprises the same number of second cavities 37, i.e. four. Further, the supporting device 25 is adapted to support the same number of container bodies 103, i.e. four, and to position the portions of them in the respective second cavities 37 of the retaining device 23. In addition, the attachment unit 5 comprises the same number of applicators 27, i.e. four, aligned with the second cavities 37, such that each applicator 27 is associated with a respective second cavity 37. With this configuration, it is possible to attach a number of, container elements simultaneously, here four at the same time. Similar as for the transfer plate 29, the second cavities 37 and the applicators 25 are arranged in a row as seen in the first direction x.

The transfer plate 29 is displaceable between a first position and a second position. In the first position, see FIG. 4, the transfer plate 29 is adapted to receive the container element 117 in the first cavity 33. Further, the transfer plate 29 is positioned, such that the cover portion 35 covers or substantially covers the second open area $A_2$ of the second cavity 37. Thereby, a loss of the protective gas through the second cavity 37 is minimized, or preferably avoided.

In the second position, see FIG. 5, the first cavity 33 is aligned with the second cavity 37 of the retaining device 23 and hence also with the applicator 27. First the transfer plate 29 is located vertically between the applicator 27 and the second cavity 37 of the retaining device 23. Thereby it is possible for the applicator 27 to displace the container element 117 from the first cavity 33 in the transfer plate 29 into the container body 103 by moving through the first cavity 33 and at least partly through the second cavity 37 of the retaining device 23. In the illustrated embodiment, the container element is constituted by the bottom rim 117. Therefore, the container body 103 is held upside down, such that its bottom end opening 113 faces upwards.

In order to attach the container element 117 to the container body 103, the retaining device 23 comprises a welding unit 39, preferably arranged around the second cavity 37. The welding unit 39 is adapted to weld the container element 117 to the container body 103, e.g. the welding unit 39 comprising a coil extending around the second cavity 37. If the applicator 27 is expandable in a radial direction of the second cavity 37, the container element can be pressed against the welding unit 39. Any suitable welding technique may be used, such as ultrasonic welding or high frequency welding, with high frequency welding being preferred.

As an alternative or a complement to welding, an adhesive may be applied to the container element before attaching it to the container body.

An exemplary method of attaching a container element 117 to a container body 103 by means of an attachment unit 5 as disclosed herein comprises:

- Positioning the transfer plate 29 in the first position, see FIG. 4.
- Placing the container element 117 in the first cavity 33.
- Displacing the transfer plate 29 to the second position, see FIG. 5.
- Displacing the container element 117 from the first cavity 33 in the transfer plate 29 into the container body 103 by means of the applicator 27 by moving through the first cavity 33 and at least partly through the second cavity 37 of the retaining device 23.
- Fixing the container element 117 to the container body 103, e.g. by means of welding and/or an adhesive.

Thereafter the transfer plate 29 is displaced back to the first position and the cycle can start again.

The container element is placed in the first cavity 33 of the transfer plate 29 by means of a container element supplier 41 comprising at least one gripping unit 42. A pile of container elements, e.g. bottom rims 117, are stored in a magazine 43. The number of piles in the magazine 43 and the number of gripping units 42 correspond to the number of first cavities 33 in the transfer plate 29, in the illustrated case four piles. The gripping unit 42 is able to grip a single container element, here the bottom rim 117, move it from an opening 45 in the magazine 43 and place it in the corresponding first cavity 33. In the illustrated embodiment, four single container elements 117 are gripped at the same time. The gripping unit 42 comprises four gripping members 44*a*, 44*b*, 44*c*, 44*d*, which grip at the corners of the container element 117. The positions of the gripping members 44*a*, 44*b*, 44*c*, 44*d* correspond to the positions of the indentations 36 of the transfer plate 29.

Figure 7:
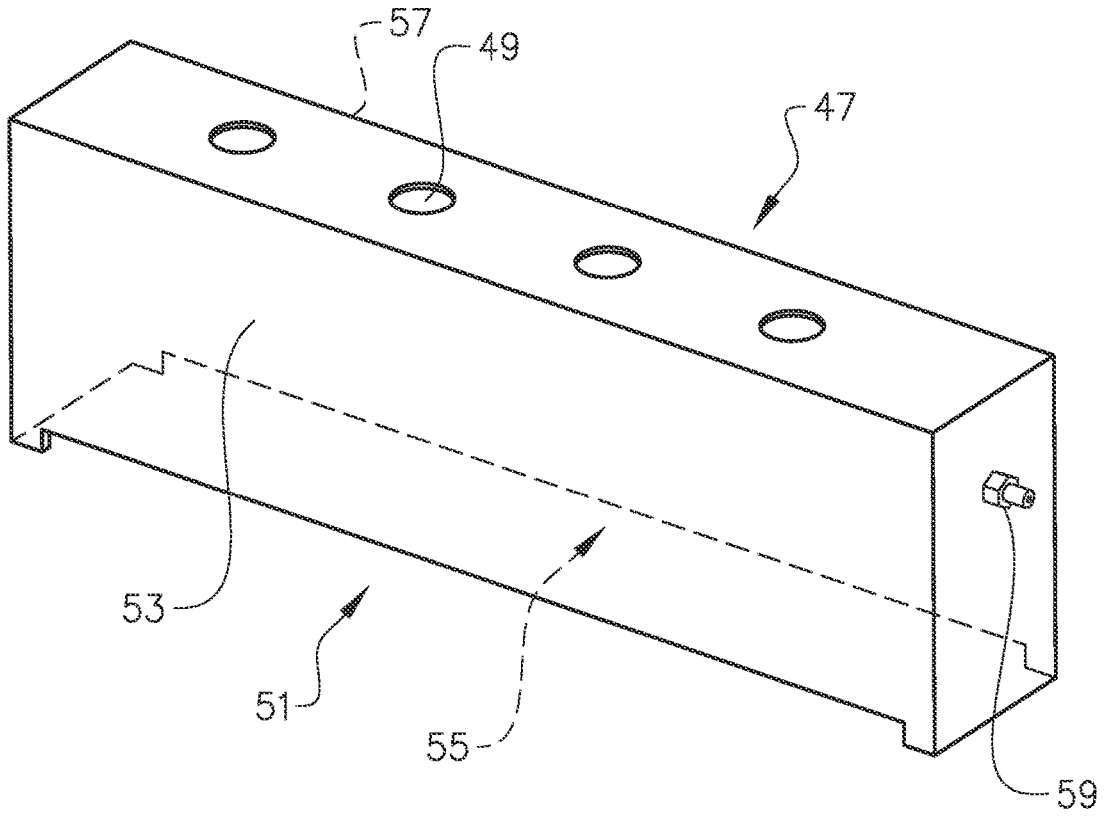
FIG. 7 shows an internal housing.

As an option, the attachment unit 5 may comprise an internal housing 47, see FIG. 7. The internal housing 47 is indicated by point-dashed lines in FIGS. 4 and 5. The internal housing 47 is located inside the external housing 7 and is arranged to provide an additional protective gas atmosphere above the second cavity 37 of the retaining device 23. The internal housing 47 comprises a gap 51 located at a first side wall 53 of the internal housing facing the container element supplier 41. The transfer plate 29 is displaceable within the gap 51 between the above-mentioned first and second positions by translational movement relative to the internal housing 47 in the gap 51, wherein in the first position of the transfer plate 29 the first cavity 33 is outside the internal housing 47, see FIG. 4, and in the second position of the transfer plate 29, the first cavity 33 is inside the internal housing 47, see FIG. 5.

Depending on the size of the internal housing 47, there may also be an additional gap 55, e.g. located at a second side wall 57 of the internal housing 47, which second side wall 57 is opposite to that of the first side wall 53. When the transfer plate 29 is in its second position, parts of the transfer plate 29, e.g. the cover portion 35, may protrude through the additional gap 55. See FIGS. 5 and 7.

In the illustrated embodiment, the retaining device 23 forms a bottom wall of the internal housing 47, which partly encloses the applicator 27. A top wall of the internal housing 47 comprises four openings 49, through which the applicators 27 pass. The applicators 27 are axially displaceable in relation to the internal housing 47, such that the applicators 47 are able to perform the above-mentioned displacement of the applicators 47 through the first cavity 33 and at least partly through the second cavity 37 of the retaining device 23. One or more seals, e.g. bushings, may be located on a respective rod 50 of the applicators 27 and/or around circumferences of the openings 49 in order to prevent gas from leaking out from the internal housing 47. As an alternative, the internal housing may enclose the whole applicator or the retaining device.

The internal housing 47 is provided with a gas inlet 59 for supplying additional protective gas.

The internal housing 47 is especially useful when the container element does not comprise a disc shape, but instead forms a loop, which comprises an inner volume filled by gas, e.g. air, such as the bottom rim 117. In that case, the air being transported with the container element into the external housing 7 of the apparatus 1 is undesired, since it adds air to the protective gas. However, by utilizing the internal housing 47, the air is dispersed in the protective gas atmosphere of the internal housing 47 and hence the effect of the air is minimized. Further, by utilizing the internal housing 47, an amount of protective gas corresponding to the volume of air transported in the inner volume of the container element may be added to the internal housing 47 to retain the protective gas atmosphere. In case the above-mentioned welding unit 39 is utilized, the gas inlet 59 can be used to supply additional protective gas, such that it can be ascertained that there is no air, or substantially no air, present when welding. The amount of added gas thus preferably corresponds to at least the amount of air transported with the bottom rim 117.

Further modifications of the invention within the scope of the appended claims are feasible. As such, the present invention should not be considered as limited by the embodiments and figures described herein. Rather, the full scope of the invention should be determined by the appended claims, with reference to the description and drawings.

The invention claimed is:

1. An attachment unit for attaching a container element to a container body, said attachment unit comprising:

a retaining device, adapted to retain said container body while said container element is being attached to said container body, an applicator for positioning said container element in said container body, a transfer plate for a container element, said transfer plate extending in a first direction and a second direction being perpendicular to each other, said transfer plate comprising a cavity portion comprising at least one through-going first cavity adapted to receive and hold said container element, said first cavity having a first open area, characterized in that said transfer plate further comprises a cover portion being at least as large as, or substantially as large as, said first open area, wherein said retaining device comprises at least one through-going second cavity with a second open area corresponding to that of said first open area, said second cavity being adapted to receive a portion of said container body, said applicator is aligned with said second cavity, said transfer plate is displaceable between a first position, in which said transfer plate is adapted to receive said container element in said first cavity, and a second position in which said first cavity is aligned with said second cavity of said retaining device, said transfer plate in said first position being located, such that said cover portion covers or substantially covers said second open area, said transfer plate in said second position being located between said applicator and said second cavity of said retaining device, such that said container element is displaceable by means of said applicator from said first cavity in said transfer plate into said container body by moving through said first cavity and at least partly through said second cavity of said retaining device.

2. The attachment unit according to claim 1, wherein said cover portion is arranged adjacent to said cavity portion as seen in said second direction.

3. The attachment unit according to claim 1, wherein said cover portion has a minimum extension in said second direction which is at least 1.0 times a maximum extension in said second direction of said first open area.

4. The attachment unit according to claim 1, wherein said transfer plate comprises one or more holding elements adapted to hold said container element in said first cavity, said holding element being located at a wall of said first cavity.

5. The attachment unit according to claim 1, wherein said transfer plate comprises one or more indentations adapted to allow space for gripping of said container element, said indentation being located at a corner of said first cavity.

6. The attachment unit according to claim 1, wherein said transfer plate comprises a plurality of cavity portions, each cavity portion comprising a respective first cavity and arranged together with a corresponding cover portion, said cavity portions being arranged in a row as seen in said first direction.

7. The attachment unit according to claim 1, wherein said attachment unit further comprises an internal housing being arranged to provide and maintain a protective gas atmosphere above said second cavity of said retaining device, said internal housing comprising a gap, said transfer plate being displaceable between said first and second positions by translational movement relative to said internal housing in said gap, wherein in said first position of said transfer plate said first cavity is outside said internal housing and in said second position of said transfer plate said first cavity is inside said internal housing.

8. The attachment unit according to claim 7, wherein said internal housing comprises a gas inlet.

9. The attachment unit according to claim 1, wherein said retaining device comprises a welding unit, arranged around said second cavity, said welding unit being adapted to weld said container element to said container body, e.g. said welding unit comprising a coil extending around said second cavity.

10. The attachment unit according to claim 1, wherein said transfer plate comprises a plurality of cavity portions, each cavity portion comprising a respective first cavity and arranged together with a corresponding cover portion, said cavity portions being arranged in a row as seen in said first direction, said retaining device comprises a plurality of second cavities, said attachment unit comprises a plurality of applicators aligned with said second cavities, such that each applicator is associated with a respective second cavity, said second cavities and said applicators being arranged in a row as seen in said first direction.

11. The attachment unit according to claim 10, wherein said applicators are adapted to simultaneously position said plurality of container elements in said respective container bodies.

12. An apparatus for attaching container elements to container bodies in a flow of containers, said apparatus comprising:

a transport means configured to transport said flow of containers through said apparatus, at least one attachment unit according to claim 11 arranged along said transport means.

13. The apparatus according to claim 12 comprising:

a first attachment unit arranged along said transport means arranged to attach a disc, e.g. a bottom disc, to said container body, a second attachment unit arranged along said transport means arranged to attach a reinforcing rim to said container body, said second attachment unit being located downstream of said first attachment unit.

14. The apparatus according to claim 12 further comprising an external housing arranged to enclose said transport means and said at least one attachment unit.

15. A method of attaching a container element to a container body by means of an attachment unit according to claim 1, said method comprising:

positioning said transfer plate in said first position, placing said container element in said first cavity, displacing said transfer plate to said second position, displacing said container element from said first cavity in said transfer plate into said container body by means of said applicator by moving through said first cavity and at least partly through said second cavity of said retaining device, fixing said container element to said container body, e.g. by means of welding and/or an adhesive.

16. The method according to claim 15, performed by means of said attachment unit, wherein said transfer plate comprises a plurality of cavity portions, each cavity portion comprising a respective first cavity and arranged together with a corresponding cover portion, said cavity portions being arranged in a row as seen in said first direction, said retaining device comprises a plurality of second cavities, said attachment unit comprises a plurality of applicators aligned with said second cavities, such that each applicator is associated with a respective second cavity, said second cavities and said applicators being arranged in a row as seen in said first direction, said applicators are adapted to simultaneously position said plurality of container elements in said respective container bodies, and said plurality of container elements are simultaneously positioned into said respective container bodies by said applicators.

17. The method according to claim 15, wherein said container element is a rim, said method comprising:

supplying additional protective gas, in an amount corresponding to an amount of gas being located in a volume delimited by said rim.

* * * * *